US006395465B1

(12) United States Patent
Maskasky et al.

(10) Patent No.: US 6,395,465 B1
(45) Date of Patent: May 28, 2002

(54) PREPARATION OF HIGH BROMIDE PHOTOGRAPHIC EMULSIONS WITH STARCH PEPTIZER

(75) Inventors: Joe E. Maskasky; Victor P. Scaccia, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,446

(22) Filed: Dec. 7, 2000

(51) Int. Cl.[7] ..... G03C 1/005; G03C 1/494

(52) U.S. Cl. ..... 430/567; 430/569; 430/639; 430/641

(58) Field of Search ..... 430/567, 569, 430/639, 641

(56) References Cited

U.S. PATENT DOCUMENTS

| | | | | | |
|---|---|---|---|---|---|
| 5,284,744 | A | | 2/1994 | Maskasky | |
| 5,411,853 | A | * | 5/1995 | Maskasky | 430/569 |
| 5,604,085 | A | | 2/1997 | Maskasky | |
| 5,620,840 | A | | 4/1997 | Maskasky | |
| 5,667,955 | A | | 9/1997 | Maskasky | |
| 5,691,131 | A | | 11/1997 | Maskasky | |
| 5,693,459 | A | | 12/1997 | Maskasky | |
| 5,726,008 | A | | 3/1998 | Maskasky | |
| 5,733,718 | A | | 3/1998 | Maskasky | |
| 5,763,151 | A | * | 6/1998 | Brust et al. | 430/569 |
| 5,804,363 | A | * | 9/1998 | Maskasky et al. | 430/567 |
| 6,027,869 | A | | 2/2000 | Maskasky et al. | |
| 6,090,536 | A | | 7/2000 | Maskasky et al. | |
| 6,100,019 | A | * | 8/2000 | Brust et al. | 430/569 |
| 6,187,525 | B1 | * | 2/2001 | Maskasky et al. | 430/567 |
| 6,225,036 | B1 | * | 5/2001 | Maskasky et al. | 430/567 |

OTHER PUBLICATIONS

"Das Redoxverhalten des latenten Innenbildes", R. Matejec and E. Moisar, (with English translation, "The redox behavior of the latent interior image"), Photographische Korrespondenz, vol. 101 (4), 1965, pp. 53–60.

T. Tani, "Photographic Effects Of Electorn And Positive Hole Traps In Silver Halides", Photographic Science And Engineering, vol. 15, No. 3, May–Jun. 1971, pp. 181–188.

Roy L. Whistler and Richard Schweiger, "Oxidation Of Amylopectin With Hypochlorite At Different Hydrogen Ion Concentrations", J. Am. Chem. Soc., vol. 79, pp. 6460–6464, 1957.

K. F. Patel, H. U. Mehta, and H. C. Srivastava, "Kinetics And Mechanism Of Oxidation Of Starch With Sodium Hypochlorite", Journal of Applied Polymer Science, vol. 18, pp. 289–399, 1974.

Jehudah Eliassaf and Jeanine Bel–Ayche, "The Interaction Of Starch With Bromine In Acid Solution", Carbohydrate Research, vol. 5, pp. 470–476, 1967.

B. Perlmutter–Hayman and Y. Weissmann, "The Kenetics Of Ethanol And Of Acetaldehyde By Bromine In Aqueous Solution", J. Am. Chem. Soc. vol. 84, pp. 2323–2326, 1962.

B. Perlmutter–Hayman and A. Persky, "The Kenetics Of The Oxidation Of D–Glucose By Bromine And By Hypobromous Acid", J. Am. Chem. Soc. vol. 82, pp. 276–279, 1960.

B. Perlmutter–Hayman and A. Persky, "The Influence Of Ionic Strength And Of Temperature On The Rate Of Oxidation Of D–Glucose By Bromine", J. Am. Chem. Soc. vol. 82, pp. 3809–3810, 1960.

* cited by examiner

*Primary Examiner*—Geraldine Letscher
(74) *Attorney, Agent, or Firm*—Andrew J. Anderson

(57) ABSTRACT

A process for precipitating a high bromide silver halide emulsion in an aqueous medium is disclosed comprising growing nucleated silver halide grains in a reaction vessel in the presence of a peptizer comprising a water dispersable starch to form high bromide radiation-sensitive silver halide grains, wherein the majority of grain growth in the reaction vessel is performed at a pH of less than 3.5. Growth of high bromide silver halide emulsion grains in the presence of a starch peptizer at low pH in accordance with the invention results in emulsion grains with lower fog, even in the absence of the use of strong oxidizing agents during grain precipitation.

24 Claims, No Drawings

PREPARATION OF HIGH BROMIDE PHOTOGRAPHIC EMULSIONS WITH STARCH PEPTIZER

FIELD OF THE INVENTION

The invention relates to silver halide photography. More specifically, the invention relates to radiation-sensitive high bromide emulsions prepared in the presence of starch peptizer and photographic elements employing such emulsions.

BACKGROUND OF THE INVENTION

The most widely used forms of photographic elements are those that contain one or more silver halide emulsions. Silver halide emulsions are usually prepared by precipitating silver halide in the form of discrete grains (microcrystals) in an aqueous medium. An organic peptizer is incorporated in the aqueous medium to disperse the grains. Varied forms of hydrophilic colloids are known to be useful as peptizers, but the overwhelming majority of silver halide emulsions employ gelatino-peptizers. A summary of conventional peptizers, including gelatino-peptizers, is provided by *Research Disclosure,* Vol. 389, September 1996, Item 38957, II. Vehicles, vehicle extenders, vehicle-like addenda and vehicle related addenda, A. Gelatin and hydrophilic colloid peptizers. *Research Disclosure* is published by Kenneth Mason Publications, Ltd., Dudley House, 12 North St., Emsworth, Hampshire PO10 7DQ, England. The term "vehicle" includes both the peptizer used to disperse silver halide grains as they are being formed and the binder used in coating emulsion and processing solution penetrable layers of photographic elements. Gelatin and gelatin derivatives are commonly employed to perform the functions of both peptizer and binder. While gelatin is by far the most widely used peptizer in the photographic emulsion arts, it has been shown that water dispersable starches may also be used as a peptizer to make silver halide emulsion grains (U.S. Pat. No. 5,284,744).

A dramatic increase in photographic speeds in silver halide photography began with the introduction of tabular grain emulsions into silver halide photographic products in 1982. A tabular grain is one which has two parallel major faces that are clearly larger than any other crystal face and which has an aspect ratio of at least 2. The term "aspect ratio" is the ratio of the equivalent circular diameter (ECD) of the grain divided by its thickness (the distance separating the major faces). Tabular grain emulsions are those in which tabular grains account for greater than 50 percent of total grain projected area. Kofron et al U.S. Pat. No. 4,439,520 illustrates the first chemically and spectrally sensitized high aspect ratio (average aspect ratio >8) tabular grain emulsions. In their most commonly used form tabular grain emulsions contain tabular grains that have major faces lying in {111} crystal lattice planes and contain greater than 50 mole percent bromide, based on silver. A summary of tabular grain emulsions is contained in *Research Disclosure,* Item 38957, cited above, I. Emulsion grains and their preparation, B. Grain morphology, particularly sub-paragraphs (1) and (3).

Pushing starch made emulsions towards high speed has been hampered by difficulties in making large tabular grain sizes. The use of less grain-growth-restraining cationic starches as a peptizer for the precipitation of high bromide {111} tabular grain emulsions has addressed such difficulty, as taught by Maskasky U.S. Pat. Nos. 5,604,085, 5,620,840, 5,667,955, 5,691,131, and 5,733,718. Under comparable levels of chemical sensitization for high bromide {111} tabular grain emulsions, higher photographic speeds can be realized using cationic starch peptizers as taught by such patents. Alternatively, speeds equal to those obtained using gelatino-peptizers can be achieved at lower sensitization temperatures, thereby avoiding unwanted grain ripening. The use of oxidized cationic starches are particularly advantageous in exhibiting lower levels of viscosity than gelatino-peptizers, which facilitates mixing.

It has also been observed that employing a starch peptizer for emulsion grain precipitation may result in somewhat higher minimum densities (i.e., fog) than when a gelatino-peptizer is substituted, even when conventional antifoggants and stabilizers are present in the emulsion. It is likely a result of silver reduction by the starch aldehyde groups. This type of reduction is well known and is the basis for a test for aldehyde groups at ammonium hydroxide pH known as the Tollens' test or "silver mirror" test:

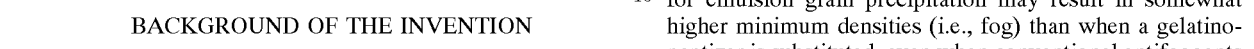

$$R—CHO+2Ag(NH_3)_2^{+}+3OH^{-}\rightleftharpoons 2Ag+R—COO^{-}+4NH_3+2H_2O$$

Starch aldehyde groups can come about from three sources: (1) starch, being a polymer of glucose, a reducing sugar, has a natural aldehyde group at one end of each polymer strand, (2) hydrolysis of a polymer strand would make a new terminal aldehyde group in addition to the previous aldehyde group, and (3) partial oxidation of a C—C bond in the glucopyranose ring can create two new aldehyde groups at the carbon bond scission point.

Fog may be reduced in starch precipitated emulsions by treating the emulsion (either during or after precipitation) with an oxidizing agent as disclosed, e.g., in U.S. Pat. Nos. 6,027,869 and 6,090,536, where the oxidizing agent establishes an oxidation potential capable of oxidizing metallic silver. Specifically preferred oxidizing agents employed during the preparation of high bromide emulsions precipitated with starch peptizers are halogens, e.g., bromine ($Br_2$) or iodine ($I_2$), and bromine or iodine generating agents. Elemental bromine and bromine-generating agents (such as an acidified solution of sodium hypochlorite containing sodium bromide) have been found to be particularly effective oxidants. When bromine or iodine is used as an oxidizing agent, the bromine or iodine is reduced to $Br^-$ or $I^-$. These halide ions can simply remain with other excess halide ions in the dispersing medium of the emulsion or be incorporated within the high bromide grains without adversely influencing photographic performance.

The reaction of starch and oxidizing agents such as bromine at typical pH values conventionally used for gelatin peptized emulsions can also rapidly deplete the oxidizing agent, however, requiring the frequent addition of relatively high levels of oxidant to maintain desired high oxidation potentials sufficient for bleaching internal grain fog centers. Health concerns have arisen concerning the handling and generation of significant amounts of volatile halides during emulsion grain manufacture. Accordingly, it would be desirable to provide an emulsion grain precipitation process employing starch peptizer which would enable a reduction in the amount of volatile halides such as bromine which are added to or generated in an emulsion precipitation reaction vessel, and more preferably to completely eliminate the need to handle or add such volatile halides directly to the vessel, while still reducing fog generation in the precipitated emulsion grains.

SUMMARY OF THE INVENTION

In one aspect, this invention is directed to a process for precipitating a high bromide silver halide emulsion in an aqueous medium comprising growing nucleated silver halide grains in a reaction vessel in the presence of a peptizer comprising a water dispersable starch to form high bromide radiation-sensitive silver halide grains, wherein the majority of grain growth in the reaction vessel is performed at a pH of less than 3.5. Growth of high bromide silver halide emulsion grains in the presence of a starch peptizer at low pH in accordance with the invention has surprisingly resulted in emulsion grains with lower fog, even in the absence of the use of strong oxidizing agents during grain precipitation.

DETAILED DESCRIPTION OF THE INVENTION

The present invention is generally applicable to the precipitation of high bromide silver halide emulsions carried out by the reaction of soluble halide salt and a soluble silver salt in the presence of water-dispersable starch as a peptizer. The term high bromide is used to define a silver halide emulsion comprising at least 50 (preferably 70 and optimally 90) mole percent bromide, based on silver, with any remaining halide being bromide, chloride, or mixtures thereof. Iodide can be present in levels up to saturation, but is preferably limited to less than 20 (optimally less than 12) mole percent, based on silver. Silver bromide, chlorobromide, iodochlorobromide, chloroiodobromide and iodobromide emulsions are contemplated. Any form of starch can be used as a peptizer providing that it is water-dispersable in the concentrations necessary to provide protection of the grains from coalescence or flocculation.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch. Illustrations of varied types of starch are set out by Whistler et al *Starch Chemistry and Technology,* $2^{nd}$ Ed., Academic Press, 1984. Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

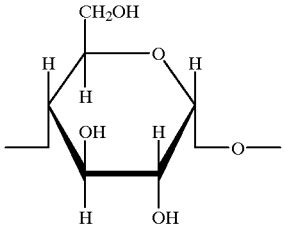

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

To be useful as a peptizer the starch must be water dispersible. Many starches disperse in water upon heating to temperatures up to boiling for a short time (e.g., 5 to 30 minutes). High sheer mixing also facilitates starch dispersion. The presence of ionic substituents increases the polar character of the starch molecule and facilitates dispersion. The starch molecules preferably achieve at least a colloidal level of dispersion and ideally are dispersed at a molecular level—i.e., dissolved.

The conventional procedures for the precipitation of radiation-sensitive silver halide emulsions employing organic peptizers, such as gelatin, gelatin derivative, starch and cellulose derivative peptizers, modified only by the substitution of starch in like amounts for the conventional peptizer and growth of the emulsion grains at low pH, can be employed in the practice of the invention. Grain nucleation and subsequent growth during the precipitation process may occur in the same or separate reaction vessels. In the context of the preparation of emulsions the term "nucleation" refers to that stage of the precipitation or preparation process in which stable new silver halide grains are being formed or otherwise introduced into the reaction vessel. The term "growth" refers to that portion of the precipitation or preparation process in which existing silver halide grains are being increased in size in the reaction vessel. Growth of existing grains may occur with or without an additional stable grain population being introduced or formed, resulting in relatively polydisperse or monodisperse emulsion grain sizes. A summary of conventional emulsion precipitations can be found in *Research Disclosure,* Item 36544, cited above, Section I, Emulsion grains and their preparation. Starch peptizer concentrations of from 0.1 to 10 percent, by weight, more preferably 0.5 to 4 percent, based on the total weight of emulsion as prepared by precipitation, can typically be employed. Mixtures of water-dispersable starches are also contemplated as peptizers within the invention as equivalent to starch from a single source.

High bromide emulsions prepared in accordance with the invention can include coarse, medium or fine silver halide grains and can be prepared by a variety of techniques, e.g., single-jet, double-jet (including continuous removal techniques) accelerated flow rate and interrupted precipitation techniques. Emulsion grains prepared in accordance with the invention can vary in size from Lippmann sizes up to the largest photographically useful sizes. For tabular grain emulsions, average maximum useful sizes range up to equivalent circular diameters (ECD's) of 10 μm. However, tabular grains rarely have average ECD's in excess of 5 μm. Nontabular grains seldom exhibit grain sizes in excess of 2 μm. Emulsions having different grain sizes and halide compositions can of course be blended to achieve desired effects.

In accordance with the invention, the majority (i.e., at least 50 mole percent) of grain growth during emulsion grain precipitation in the reaction vessel, and preferably precipitation of greater than 70 mole % (more prefereably greater than 90 mole %) of the emulsion grains based on total silver, is performed at a relatively low pH of less than 3.5, preferably less than or equal to 3.0, more preferably less than or equal to 2.5 and most preferably less than or equal to 2.0.

While the use of a low pH environment with starch peptizers during grain growth may result in starch hydrolysis leading to the formation of additional aldehyde groups (which are believed to reduce silver ions to generate fog silver centers in emulsion grains), growth of high bromide silver halide emulsion grains at low pH in the presence of a starch peptizer has surprisingly resulted in fewer fog generating grains, even in the absence of use of a strong oxidizing agent during emulsion grain precipitation as was previously thought required to oxidize silver fog centers as they are formed. Maintenance of a low pH environment during grain growth in accordance with the invention is believed to sufficiently suppress the silver ion redaction reaction such that silver centers are not formed at photographically harmful levels, leading to low fog emulsions. As such, in accordance with preferred embodiments of the invention, the addition or generation of strong oxidizing agents in the reaction vessel to raise the oxidation potential above levels believed required to oxidize internal silver centers (i.e., at least 650 mV (Ag/AgCl ref.)) during grain growth is not needed. While establishing a relatively low pH value is advantageous during grain growth, extremely low pH would be expected to degrade the starch peptizer, therefore a pH value of at least 1.0 is also preferred.

In the preparation of silver halide emulsions other than tabular grain emulsions, the starch peptizer can be cationic, anionic or non-ionic. It is preferred, however, in connection with silver halide grain precipitation generally, and typically necessary in preparing tabular grain emulsions, to employ a water dispersible starch or derivative as a peptizer that is cationic, i.e., that contains an overall net positive charge when dispersed in water. Starches are conventionally rendered cationic by attaching a cationic substituent to at least a portion of the α-D-glucopyranose units, usually by esterification or etherification at one or more free hydroxyl sites. Reactive cationogenic reagents typically include a primary, secondary or tertiary amino group (which can be subsequently protonated to a cationic form wider the intended conditions of use) or a quaternary ammonium, sulfonium or phosphonium group.

The following teachings, the disclosures of which are here incorporated by reference, illustrate water dispersible cationic starches within the contemplation of preferred embodiments of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. 3,077,469;
Elizer et al U.S. Pat. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

It is further preferred to employ an oxidized starch as the starch peptizer, and in particular an oxidized cationic starch. The starch can be oxidized before (* patents above) or following the addition of cationic substituents. This may be accomplished by treating the starch with a strong oxidizing agent. Both hypochlorite ($ClO^-$) or periodate ($IO_4^-$) have been extensively used and investigated in the preparation of commercial starch derivatives and are preferred. While any convenient oxidizing agent counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are usually at the 2 and 3 position carbon atoms forming the α-D-gluopyranose ring. The 2 and 3 position

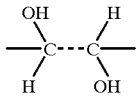

groups are commonly referred to as the glycol groups. The carbon-to-carbon bond between the glycol groups is replaced in the following manner:

(II)

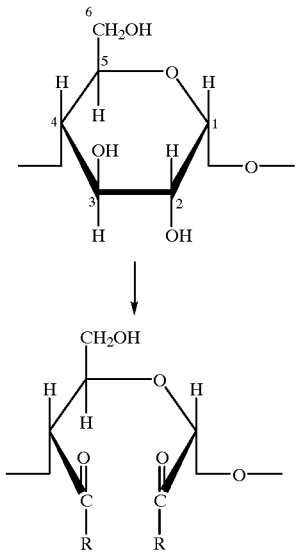

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming mixtures of carbonyl and carboxyl groups, i.e., aldehydes, ketones, and carboxylic acid groups. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the preparation of high bromide emulsions, e.g., up to a pBr of 3.0.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.,* Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc., Vol.* 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science,* Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science:* Part A, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science,* Vol. 18, pp. 389–399 (1974); R. L. Whistler, J. N. Bemiller and E. F. Paschall, *Starch: Chemistry and Technology,* Chapter X, Starch Derivatives: Production and Uses, II. Hypochlorite-Oxidized Starches, pp. 315–323, Academic Press, 1984; and O. B. Wurzburg, *Modified Starches: Properties and Uses,* III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J Chem., Vol.*312–321(1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.,* 1953, pp. 3631–3635; P. J. Borchert and J. Mirza, "Cationic Dispersions of Dialdehyde Starch I. Theory and Preparation", *Tappi,* Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.,* pp. 2121–2127 (1966); and O. B. Wurzburg, *Modified Starches: Properties and Uses,* III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.,* Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated for oxidized starches in accordance with preferred embodiments is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

In substituting oxidized cationic starch for conventional organic peptizers in accordance with preferred embodiments of the invention, a few significant differences can be observed. First, whereas conventionally silver halide precipitations are conducted in the temperature range of from 30 to 90° C., in the preparation of emulsions with starch peptizers the temperature of precipitation can range down to room temperature or even below. For example, precipitation temperatures as low as 0° C. are within the contemplation of the invention. Unlike conventional peptizers such as gelatino-peptizers, oxidized cationic starch does not "set up" at reduced temperatures. That is, the viscosity of the aqueous dispersing medium containing the cationic starch remains low. Additionally, starch, unlike gelatin, also advantageously has adequate stability at the combination of high acidity and high emulsion precipitation temperatures.

Although cationic starch is a highly effective peptizer, preventing clumping of silver halide grains as they are formed and grown, use of such peptizer does not in all instances result in the formation of high bromide grains of the same shape, size and dispersity that would be formed in the presence of the replaced conventional organic peptizer. For example, cationic starch shows a much greater propensity toward the formation of grains having {111} crystal faces. This, of course, is highly advantageous in substituting cationic starch for conventional peptizers in emulsion preparations that conventionally produce grains having {111} crystal faces, such as octahedra and tabular grains, including ultrathin (<0.07 $\mu$m) tabular grains, having {111} crystal faces. However, in precipitations that require grain growth modifiers to control crystal habit, varied grain characteristics are obtained, depending upon the specific grain growth modifier present.

It is an advantage of the invention that low pH during emulsion grain precipitation employing starch peptizers has been found to result in relatively clean (i.e., low fog) emulsions even in the absence of the use of oxidizing agents sufficiently strong to oxidize silver fog centers. If desired, however, such oxidizing agents may additionally be used during or after emulsion grain precipitation to oxidize any silver fog centers which may be formed. The effectiveness of an oxidizing agent depends on the minimum oxidation potential required to oxidize any silver fog centers that are present. Surface image fog, if free of gold, can be removed by oxidizing solutions only a little more positive than the macroscopic electrochemical (Ag+/Ag) equilibrium potential. The oxidation of internal silver centers, however, requires significantly higher oxidation potentials than surface silver centers. In contrast to surface-image (surface-fog centers), internal-image (internal-fog centers) are surrounded by silver halide so their oxidation has to tale place indirectly by and through the silver halide phase. In a study examining the oxidation of gold-free internally light fogged core-shell AgCl and AgBr cubic emulsions (R. Matejec and E. Moisar, Photogr. Korr., 101:53 (1964)), it was reported that only in the case of very positive oxidation potentials could a degradation of the internal fog be seen. To obtain maximal bleaching effect on the internal fog generally required bathing of the emulsion coatings in solutions having potentials of at least 650 mV (when converted to Ag/AgCl as reference electrode).

As taught in copending, commonly assigned, concurrently filed U.S. Ser. No. 09/731,445. the disclosure of which is incorporated herein by reference, it is an additional advantage of low pH conditions that an unexpectedly significant, reduction in the rate of reaction between strong oxidants, such as bromine, and starch can reduce the amount of oxidizing agent which must be added during the course of or after precipitation to achieve and maintain a desired high oxidation potential sufficient to oxidize silver metal fog centers which may be formed during precipitation, particularly internal fog centers. Accordingly, reduced amounts of strong oxidizing agents (such as bromine or bromine-generating compounds) which are capable of establishing an oxidation potential of at least 650 mV (Ag/AgCl ref.) may be added to the reaction vessel during or after at least a part of the precipitation of the starch peptized high bromide emulsion grains, at relatively low pH (e.g., concentrations of oxidizing agent added to the emulsion may be preferably reduced to a level sufficient to provide an equivalent of from $1\times10^{-6}$ to $1\times10^{-3}$ mole elemental bromine per mole of precipitated silver halide as still be effective to establish an oxidation potential of above 650 mV, where the silver basis is the total silver at the conclusion of precipitation of the high bromide emulsion). As explained above, such high oxidation potentials are generally sufficient to bleach internal as well as surface fog centers which may be formed during emulsion grain precipitation. In accordance with preferred embodiments of the present invention, however, such strong oxidizing agents generally need not be employed at any significant level (e.g., concentrations of oxidizing agent added which provide an equivalent of less than $1\times10^{-6}$ mole elemental bromine per mole of precipitated silver halide) to avoid formation of silver metal fog centers during emulsion grain precipitation at relatively low pH, and the oxidation potential accordingly need not be above 650 mV during the majority of grain growth.

High bromide emulsions grains prepared in accordance with preferred embodiment of the invention may comprise tabular grains, wherein starch (preferably cationic) is substituted for gelatin in conventional emulsion grain precipitation processes. A summary of tabular grain emulsions is contained in *Research Disclosure,* Item 38957, cited above, I. Emulsion grains and their preparation, B. Grain morphology, particularly sub-paragraphs (1) and (3). In a particularly preferred embodiment, the invention is directed towards the preparation high bromide {111} tabular grain emulsions, wherein a water dispersible cationic starch is present during the precipitation (during nucleation and grain growth or during grain growth) of high bromide {111} tabular grains. High bromide {111} tabular grain emulsions are those in which greater than 50 percent of total grain projected area is accounted for by tabular grains having {111} major faces and containing greater than 50 mole percent bromide, based on silver.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be useful in the practice of the invention, subject to the selected peptizer, oxidizing agent and pH modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;

Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsatur et al U.S. Pat. No. 5,147,771;
Tsaur et al U.S. Pat. No. 5,147,772;
Tseur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kima et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed in accordance with preferred embodiments of the invention preferably contain at least 70 (optimally at least 90) mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 12 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

The high bromide {111} tabular grain emulsions can exhibit mean grain ECD's of any conventional value, ranging up to 10 $\mu$m, which is generally accepted as the maximum mean grain size compatible with photographic utility. In practice, the tabular grain emulsions typically exhibit a mean ECD in the range of from about 0.2 to 7.0 $\mu$m. Tabular grain thicknesses typically range from about 0.03 $\mu$m to 0.3 $\mu$m. For blue recording somewhat thicker grains, up to about 0.5 $\mu$m, can be employed. For minus blue (red and/or green) recording, thin (<0.2 $\mu$m) tabular grains are preferred. The advantages that tabular grains impart to emulsions generally increases as the average aspect ratio or tabularity of the tabular grain emulsions increases. Both aspect ratio (ECD/t) and tabularity (ECD/$t^2$, where ECD and t are measured in $\mu$m) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 $\mu$m (preferably less than 0.2 $\mu$m and optionally less than 0.07 $\mu$m) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred. High bromide {111} tabular grain emulsions precipitated in the presence of a cationic starch are disclosed in the following patents, the disclosures of which are here incorporated by reference: Maskasky U.S. Pat. Nos. 5,604,085, 5,620,840, 5,667,955, 5,691,131, and 5,733,718.

Preferably precipitation of high bromide emulsion grains in accordance with the invention is conducted by substituting a water dispersible cationic starch for all conventional gelatino-peptizers. In substituting the selected cationic starch peptizer for conventional gelatino-peptizers, the concentrations of the selected peptizer and the point or points of addition can correspond to those typically employed using gelatino-peptizers. In addition, it has been discovered that emulsion precipitation employing cationic starch peptizer can tolerate even higher concentrations of the selected peptizer than typically may be employed for gelatino-peptizers. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation. At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

Conventional dopants can be incorporated into the high bromide grains during their precipitation, as illustrated by the patents cited above and *Research Disclosure,* Item 38957, cited above, Section I. Emulsion grains and their preparation, D. Grain modifying conditions and adjustments, paragraphs (3), (4) and (5). It is specifically contemplated to incorporate shallow electron trapping (SET) site providing dopants in the grains, further disclosed in *Research Disclosure,* Vol. 367, November 1994, Item 36736, and Olm et al U.S. Pat. No. 5,576,171, here incorporated by reference. Because starch is substantially free of nitrogen and sulfur containing material, which may form stable complexes with some metals, it may be possible in the absence of such complexing peptizers to more readily incorporate certain metals into the grains, e.g, platinum, palladium, iron, copper, and nickel compounds. Because some dopants may be subject to oxidative destruction, it is a further advantage of the invention that the use of strong oxidizing agents during grain growth at low pH is not required in the preparation of clean emulsion grains. If a strong oxidizing agent is used during precipitation, it may be preferred to delay such use until after the dopants are incorporated.

It is also recognized that silver salts can be epitaxially grown onto the emulsion grains during the precipitation process. Epitaxial deposition onto the edges and/or corners of tabular grains, e.g., is specifically taught by Maskasky U.S. Pat. No. 4,435,501 and Daubendiek et al U.S. Pat. Nos. 5,573,902 and 5,576,168, here incorporated by reference.

Although epitaxy onto the host grains can itself act as a sensitizer, emulsions prepared in accordance with the invention can provide sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure,* Item 38957, cited above, Section IV. Chemical sensitizations. It is preferred to employ at least one of noble metal (typically gold) and middle chalcogen (typically sulfur) and, most preferably, a combination of both (e.g., aurous sulfide) in preparing the emulsions of the invention for photographic use. The use of a cationic starch peptizer in accordance with preferred embodiments of the invention allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the preferred cationic starch peptizers, since ion removal is inherently limited to removing much lower molecular weight solute ions. Further, it is often convenient to add gelatin to the emulsion after washing so that it can be chill set. In such case, it is preferable to add gelatin in the form of a solution that has been pre-adjusted to the desired low pH.

The starch peptized high bromide emulsion which are precipitated at low pH (i.e., less than 3.5, preferably less than or equal to 3.0, more preferably less than or equal to 2.5 and most preferably less than or equal to 2.0) in accordance with the invention may be stored until they are chemically or spectrally sensitized. In preferred embodiments of the invention, such storage is performed at similarly low pH to prevent generation of fog silver centers after precipitation. After sensitization, added dyes and conventional antifoggants may provide fog protection at conventional higher pH storage conditions of 5 and above.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

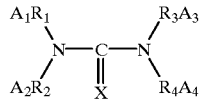

(III)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IV)}$$

wherein

L is a mesoionic compound;

X is an anion; and $L^1$ is a Lewis acid donor.

In another preferred form of the invention it is contemplated to employ alone or in combination with sulfur sensitizers, such as those formula III, and/or gold sensitizers, such as those of formula IV, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

(V)

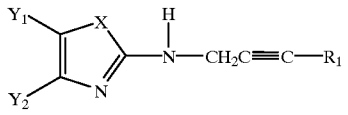

where

X=O, S, Se;

$R_1$=(Va) hydrogen or (Vb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula V compounds are generally effective (with the Vb form giving very large speed gains and exceptional latent image stability) when present during the heating step (finish) that results in chemical sensitization.

Starch peptized high bromide emulsions prepared in accordance with the invention may be advantageously employed with fragmentable electron donating sensitizers as described, e.g., in U. S. Pat. No. 6,090,536, and such emulsion may further be advantageously employed in photographic elements containing light scattering particles as described in U.S. Pat. No. 6,027,869, dye image enhancing couplers capable of releasing electron transfer agents as described in commonly assigned, copending U.S. Ser. No. 09/213,739, and one-equivalent dye-forming couplers as described in commonly assigned, copending U.S. Ser. No. 09/213,766, the disclosures of which are incorporated by reference herein. In addition, the high bromide grains may also be used in combination with conventional chemical and/or spectral sensitizers, and may also include one or more conventional antifoggants and stabilizers. A summary of conventional antifoggants and stabilizers is contained in *Research Disclosure,* Item 38957, VII. Antifoggants and stabilizers.

The starch-peptized emulsions of this invention can be used in otherwise conventional photographic elements comprising photographic emulsion layers coated on supports to serve varied applications including black-and-white and color photography, either as camera or print materials; image transfer photography; photothermography and radiography. Other sections of Research Disclosure, Item 38957 illustrate features particularly adapting the photographic elements to such varied applications.

The starch peptizer added during emulsion precipitation will typically form only a small portion of the total vehicle of a silver halide emulsion layer in a photographic element. Additional starch of the type used as a peptizer can be added to act, as a binder. However, it is preferred to employ as binders other conventional hydrophilic colloid binders, particularly gelatin and gelatin derivatives. Maskasky U.S. Pat. No. 5,726,008, here incorporated by reference, describes a vehicle that can be chill set containing at least 45 percent by gelatin and at least 20 percent of a water dispersible starch. In addition to peptizer and binder, the vehicle is reacted with a hardener to increase its physical integrity as a coating and other addenda, such as latices, are also commonly incorporated. Conventional components which can be included within the vehicle of the emulsion layer summarized in *Research Disclosure,* Item 38957, II. Vehicles, vehicle extenders, vehicle-like addenda and vehicle related addenda and IX. Coating physical property modifying addenda—e.g., coating aids (such as surfactants), plasticizers and lubricants, matting agents and antistats are common vehicle components, conventional choices being illustrated by *Research Disclosure,* Item 38957, IX. Coating physical property modifying addenda.

Photographic element supports can take the form of any conventional support. Typically the support is either transparent (e.g., a transparent film support) or a white reflective support (e.g., a photographic paper support). A listing of photographic element supports is provided in *Research Disclosure,* Item 38957, XV. Supports.

Conventional incorporated dye image providing compounds that can be present in the emulsion layers are summarized in *Research Disclosure,* Item 38957, X. Dye image formers and modifiers. Preferred dye image providing compounds are image dye-forming couplers, illustrated in paragraph B. Dye image providing compounds can be incorporated directly into the emulsion layer or, less commonly, are coated in a conventional vehicle containing layer in reactive association with (usually contiguous to) an emulsion layer. Dye-forming couplers are commonly dispersed in hydrophilic colloid vehicles in high boiling coupler solvents or in latex particles. These and other conventional dispersing techniques are disclosed in paragraph D. Dispersing dyes and dye precursors.

Although *Research Disclosure,* Items 36544 and 38957, have been used to provide specific illustrations of conventional photographic element features as well as their exposure and processing, it is recognized that numerous other publications also disclose conventional features, including the following:

James *The Theory of the Photographic Process,* 4th Ed., Macmillan, New York, 1977;

*The Kirk-Othmer Encyclopedia of Chemical Technology,* John Wiley and Sons, New York, 1993;

Neblette's *Imaging Processes and Materials,* Van Nostrand Reinhold, New York 1988; and Keller, *Science and Technology of Photography,* VCH, New York, 1993.

EXAMPLES

The invention can be better appreciated by reference to the following specific embodiments. Except as otherwise indicated, all weight percentages (wt %) are based on total weight. The suffix "C" is used to identify comparative Examples, which were not prepared in accordance with the invention.

Examples 1, 2, and 3

Starch Tabular-Grain AgIBr Emulsionr, 4% I, Made at pH 2.0 and Stored at pH 5.6, 3.0 or 2.0 Respectively.

A starch solution was prepared by heating at 80° C. for 30 min a stirred mixture of 3 kg distilled water and 160 g of an oxidized cationic starch (STA-LOK 140, obtained from A. E. Staley Manufacturing Co., Decatur, Ill., which is 100% amylopectin that had been treated to contain quaternary ammonium groups, 0.30–0.38,wt % nitrogen, and oxidized with 2wt % chlorine bleach). After cooling to 40° C., the solution was made 6.56 mM in NaBr. The pH was adjusted to 2.0 with nitric acid and maintained at this value throughout the precipitation.

To the vigorously stirred reaction vessel containing the starch solution at 40° C. and pBr of 2.13 were added solutions Sol-A (2.5 M $AgNO_3$, 0.3 mM $HNO_3$) and Sol-B (2.5 M NaBr) at 200 mL/min for 26 sec. After holding for 30 sec, Sol-B was added at 200 mL/min until the pBr reached 1.45. After holding for 30 sec, the temperature was increased to 60° C. at a rate of 1.67° C./min. After holding for 15 min at 60° C., Sol-A was added at 10 mL/min for 5 min while maintaining the pBr at 1.45 with Sol-B. Then the temperature was raised from 60 to 70° C. at 0.67° C./min and at the same time addition was started of Sol-A at 12 mL/min and Sol-B at 8 mL/min until the pBr reached 2.15. Sol-A was then accelerated from 10 mL/min to 30 mL/min in 90 min and Sol-B was added as needed to maintain a pBr of 2.15. Then Sol-A was added at 30 mL/min, and Sol-B was added as needed to maintain this pBr. The addition of Sol-A was stopped when a total of 2.24 L of Sol-A had been added and then the addition of Sol-B was increased to 100 mL/min until the pBr reached 1.28 then the addition of Sol-B was stopped. Next solution Sol-C (0.32 M KI, 0.32 M NaBr) was added at 50 mL/min until 1 L had been added. After 1 min, Sol-A was added at 30 mL/min and when the pBr reached 2.37, Sol-B was concurrently added to maintain this pBr. The precipitation was stopped when a total of 8.0 moles of silver halide had been precipitated.

During the precipitation the oxidation potential was measured using a Pt measuring electrode and a Ag/AgCl reference electrode connected to the vessel through a salt bridge filled with a 2.2M $KNO_3$, 0.4M $NaNO_3$ solution. The oxidation potential never exceeded 400 mV.

The emulsion was washed at 30° C. using ultrafiltration until the pBr reached 3.26. After washing, the emulsion was divided into three equal parts. To each part was added a pH adjusted 21.6% bone gelatin solution rapidly with good stirring at 40° C. to make a gelatin-to-silver ratio of 27 g gel per mole silver. The pBr of the emulsions was adjusted to 3.26 with NaBr sol. For Example 1, the bone gel solution and the final emulsion were adjusted to a pH of 5.6. For Example 2, the bone gel solution and the final emulsion were adjusted to a pH of 3.0 with $HNO_3$. For Example 3, the bone gel solution and the final emulsion were adjusted to a pH of 2.0 with $HNO_3$.

The resulting {111} tabular grain emulsions consisted of tabular grains having an average equivalent circular diameter of 2.6 μm, an average thickness of 0.124 μm, and an average aspect ratio of 21. The tabular grain population made up 99% of the total projected area. Analysis by transmission electron microscopy revealed that the grains with >10 edge and corner dislocations per grain were 82.% of the tabular grain population.

Example 4

Starch Tabular-Grain AgIBr Emulsion, 4% I, Made at ph 3.0 and Stored at pH 5.6

This emulsion was made similarly to that of Example 1 except that solution Sol-A was 2.5 M $AgNO_3$, 0.3 mM $HNO_3$, and the pH was maintained at 3.0 during the precipitation. The resulting {111} tabular-grain emulsion consisted of tabular grains having an average equivalent circular diameter of 2.95 μm, an average thickness of 0.129 μm, and an average aspect ratio of 23. The tabular-grain population made up 99% of the total projected area of the emulsion grains.

Example 5C

Starch Tabular-Grain AgIBr Emulsion, 4% I, Made at pH 4.0 and Stored at pH 5.6

This emulsion was made similarly to that of Example 1 except that solution Sol-A was 2.5 M $AgNO_3$ and the pH was maintained at 4.0 during the precipitation. The resulting {111} tabular-grain emulsion consisted of tabular grains having an average equivalent circular diameter of 3.10 μm, an average thickness of 0.131 μm, and an average aspect ratio of 24. The tabular-grain population made up 99% of the total projected area of the emulsion grains.

Example 6C

Staunch Tabular-Grain AgIBr Emulsion, 4% I, Made at pH 5.0 and Stored at pH 5.6

This emulsion was made similarly to that of Example 5 except that 29 mmol of sodium acetate was added to the reaction vessel as a pH buffer before the start of the precipitation and the pH was maintained at 5.0 during the precipitation. The resulting {111} tabular-grain emulsion consisted of tabular grains having an average equivalent circular diameter of 3.21 μm, an average thickness of 0.138 μm, and an average aspect ratio of 23. The tabular-grain population made up 99% of the total projected area of the emulsion grains.

Example 7

Starch Tabular-Grain AgIBr Emulsion, 4% I, Made at pH 2.0 and Stored at pH 5.6

This emulsion was made similarly to Example 1 except that solution Sol-A was 2.5 M $AgNO_3$. The {111} tabular-grain emulsion consisted of tabular grains having an average equivalent circular diameter of 2.84 μm, an average thickness of 0.131 μm, and an average aspect ratio of 22. The tabular-grain population made up 99% of the total projected area of the emulsion grains.

Example 8C

Starch Tabular-Grain AgIBr Emulsion, 4% I, Made at pH 5.0 and using Bromine as Oxidant Stored at pH 5.6

This emulsion was made similarly to Example 6C, except bromine was used as an oxidizing agent during emulsion grain precipitation.

A starch solution was prepared by heating at 80° C. for 30 min a stirred mixture of 8 kg distilled water and 160 g of the cationic starch STA-LOK 140. After cooling to 40° C., the solution was made 6.56 mM in NaBr and 3.67 mM in sodium acetate. The pH was adjusted to 5.0 and maintained at this value throughout the precipitation.

To the vigorously stirred reaction vessel containing the starch solution at 40° C. and pBr of 2.13, 2.0 mL of saturated bromine water was added. After holding for 5 min. solutions Sol-A (2.5M $AgNO_3$) and Sol-B' (2.5M NaBr, 0.45 g/L Bromine,) were added at 200 mL/min for 26 sec. After holding for 30 sec, Sol-B' was added at 200 mL/min until the pBr reached 1.45. After holding for 30 sec, the temperature was increased to 60° C. at a rate of 1.67° C./min. After holding for 15 min at 60° C., Sol-A was added at 10 mL/min for 5 min while maintaining the pBr at 1.45 with Sol-B'. Then the temperature was raised from 60 to 70° C. at 0.67° C./min and at the same time addition was started of Sol-A at 12 mL/min and Sol-B' at 8 mL/min until the pBr reached 2.15. Sol-A was then accelerated from 10 mL/min to 30 mL/min in 90 min and Sol-B' was added as needed to maintain a pBr of 2.15. Then Sol-A was added at 30 mL/min, and Sol-B' was added as needed to maintain this pBr. The addition of Sol-A was stopped when a total of 2.24 L of Sol-A had been added and then the addition of Sol-B' was increased to 100 mL/min until the pBr reached 1.28 at that point the addition of Sol-B' was stopped. Then solution Sol-C (0.32 M KI, 0.32 M NaBr) was added at 50 mL/min until 1 L had been added. After 1 min, Sol-A was added at 30 mL/min and when the pBr reached 2.37, Sol-B' was concurrently added to maintain this pBr. The precipitation was stopped when a total of 8.0 moles of silver halide had been precipitated.

A total of 1.15 mmoles of bromine per mole Ag had been used. The oxidation potential was above 650 mV during 85% of the precipitation and above 800 mV during 73% of the precipitation.

The emulsion was washed at 30° C. using ultrafiltration until the pBr reached 3.26. Then 1 L of a 21.6% bone gelatin solution was rapidly added with good stirring at 40° C. The mixture was adjusted at 40° C. to a pBr of 3.26 with NaBr sol. and a pH of 5.6.

The resulting {111} tabular grain emulsion consisted of tabular grains having an average equivalent circular diameter of 3.04 μm, an average thickness of 0.132 μm, and an average aspect ratio of 23. The tabular grain population made up 99% of the total projected area. Analysis by transmission electron microscopy revealed that the grains with >10 edge and corner dislocations per grain were 86% of the tabular grain population.

Example 9

Starch Tabular-Grain AgIBr Emulsion, 4% I, Made at ph 2 with Oxidant Added Before Start of Silver Addition and Ruthenium Hexacyanide added at 87% of Silver Addition, Stored at pH 2.0

This emulsion was made similarly to that of Example 1 except for the following three changes:

(1) Solution Sol-A was 2.5 M $AgNO_3$, (2) Five min prior to the start of the precipitation, a dilute OXONE® solution (monopersulfate compound by DuPont) was added to the reaction vessel, at 40° C., pH 2, sufficient to raise the oxidation potential to 890 mV. The amount of OXONE required (0.205 g) was equivalent to 95 mg of bromine (determined by titration of the OXONE). No additional oxidant was added during or after the precipitation. The oxidation potential dropped below 650 mV between the nucleation and growth stages of the emulsion precipitation, that is after only 2.7% of the total silver had been added. The oxidation potential remained below 650 mV for the remainder of the precipitation.

(3) When 87% of the silver had been added Oust when pBr reached 2.37), the addition of Sol-A was stopped and 50 ppm of Ru dopant in the form of a solution of potassium hexacyanoruthenate(ll) was added in ~1 min, then the precipitation was resumed.

The resulting {111} tabular-grain emulsion consisted of tabular grains having an average equivalent circular diameter of 2.62 μm, an average thickness of 0.121 μm, and an average aspect ratio of 24. The tabular-grain population made up 99% of the total projected area of the emulsion grains. Results of an elemental analysis of a sample of the emulsion that had been treated with a protolytic enzyme and extensively washed indicated that 22 ppm of ruthenium had been incorporated within the silver halide grains. Also, electron paramagnetic resonance (EPR) analysis of the emulsion showed spectra consistent with incorperation of a shallow electron trapping dopant such as hexacyanoruthenate(II).

Example 10C 1.4% Iodide AgIBr Starch Tabular-Grain Emulsion Made at pH5 and Using Bromine as Oxidant A starch solution was prepared by heating at 80° C. for 30 min a stirred mixture of 8 kg distilled water and 160 g of the cationic starch STA-LOK 140. After cooling to 40° C., the solution was made 6.56 mM in NaBr and 3.67 mM in sodium acetate. The pH was adjusted to 5.0 and maintained at this value throughout the precipitation.

To the vigorously stirred reaction vessel containing the starch solution at 40° C., 2.0 mL of saturated bromine water was added. After holding for 5 min. Sol-A (2.5 M $AgNO_3$) and Sol-B" (2.5 M NaBr, 0.4 g/L bromine) were added at 200 mL/min for 21 sec. After holding for 30 sec, solutions Sol-B" was added at 200 mL/min until the pBr reached 1.44. After holding for 30 sec, the temperature was increased to 60° C. at a rate of 1.67° C./min. After holding for 10 min at 60° C., Sol-A was added at 10 mL/min for 1 min then its flow rate was linearly accelerated to 54 mL/min during 57 min then held constant until a total of 2.4L of Sol-A had been added. Concurrently, Sol-B" was added to maintain the pBr at 1.44 until 11 min into the acceleration when solution Sol-C' (2.5 M NaBr, 0.04 M KI, and 0.45/L bromine) was substituted for Sol-B" to maintain the pBr. The precipitation was stopped when a total of 6.0 moles of silver halide had been precipitated. A total of 1.22 mmoles of bromine per mole Ag had been used.

The emulsion was washed at 30° C. using ultrafiltration until the pBr reached 3.26. Then 0.8 L of a 20% bone gelatin solution was rapidly added with good stirring at 40° C. The mixture was adjusted at 40° C. to a pBr of 3.26 with NaBr sol. and a pH of 5.6.

The resulting {111} tabular-grain emulsion consisted of tabular grains having an average equivalent circular diameter of 3.02 μm, an average thickness of 0.073 μm, and an average aspect ratio of 41. The tabular-grain population made up 99% of the total projected area of the emulsion grains.

Example 11C 1.4% Iodide AgIBr Starch Tabular-Grain Emulsion Made at pH 5 and without added Oxidant This emulsion was made similarly to Example 10C except that no bromine or other strong oxidant was used. The resulting {111} tabular-grain emulsion consisted of tabular grains having an average equivalent circular diameter of 3.84 μm, an average thickness of 0.074 μm, and an average aspect ratio of 52. The tabular-grain population made up 99% of the total projected area of the emulsion grains.

Example 12

1.4% Iodide AgIBr Starch Tabular-Grain Emulsion Made at pH 2 and without added Oxidant This emulsion was made similarly to Example 11C except that no sodium acetate was added to the reaction vessel, the pH was maintained at 2.0 during the precipitation, and the final emulsion (containing 27 g gelatin/Ag mole) was stored at pH 2.0. The resulting {111} tabular-grain emulsion consisted of tabular grains having an average equivalent circular diameter of 3.11 μm, an average thickness of 0.065 μm, and an average aspect ratio of 50. The tabular-grain population made up 99% of the total projected area of the emulsion grains.

Example 13C

Attempted Gelatin Tabular-Grain AgIBr Emulsion, 4% I, Made at pH 2 and without Oxidant This emulsion was started similarly to that of Example 1 except that low methionine bone gelatin was substituted for the starch. When the contents of the reaction vessel had been at 70° C. and pH 2.0 for 45 min, examination of the contents of the reaction vessel by optical microscopy revealed that all of the grains were clumped into large masses and the precipitation had to be terminated. The gelatin has been degraded (hydrolyzed) by the combination of low pH and high temperature to an extent that it lost its ability to function as a silver-halide-peptizing agent.

Testing Emulsions for Fog

Portions of each of the emulsions for Examples 1–12 were adjusted at 40° C. to pH 5.6, pBr 3.18, and then treated with gold. To the emulsion 6 mg/Ag mol of potassium tetrachloroaurate was added and the mixture was heated from 40 to 70° C. at a rate of 1.67° C./min, held at 70° C. for 20 min, and then cooled to 40° C. at a rate of 1.1° C./min. The resulting emulsion was coated on clear polyester support with 1.62 g/m$^2$ silver, 3.23 g/m$^2$ gelatin, surfactant, and hardener. A 2.69 g/m$^2$ gelatin layer was also coated over the emulsion layer. Portions of each emulsion in "primitive" form (i.e., not treated with gold) were also similarly coated.

For photographic evaluation, each of the emulsion coatings was exposed for 0.1 sec to a 365 nm emission line of a Hg lamp filtered through a Kodak Wratten filter number 18A and a step wedge ranging in density from 0 to 4 density units in 0.2 density steps. The exposed coatings were given four different development treatments: Kodak Rapid X-Ray Developer (KRX) or Kodak Rapid X-Ray Developer with 0.5 g/L of added KI (KRX+KI) processing, with or without a prior treatment in Fe surface bleach (3 g potassium ferricyanide and 12.5 mg phenosafranine/liter). Fog (minimum density) data obtained for the various example emulsion coatings are presented in Table I below.

This fog test is based on the observation that gold only sensitization will cause latent fog centers (silver metal centers) of primitive emulsions to become developable, i.e., detectable. The test can be used as a means of distinguishing emulsions that would have elevated fog levels when chemically :sensitized in attempting to achieve maximal photographic speed-fog performance. Heating a liquid emulsion with a Au sensitizing salt (Au only sensitization) amplifies any emulsion fog. Treating a coating of the Au-treated emulsion with surface bleach prior to development will lower surface fog and can enhance internal fog centers if present or even generate internal fog if the surface fog level is extensive (presumably by releasing electrons into the grain). For AgIBr emulsions, KRX is primarily (but not exclusively) a developer of surface image, while KRX+KI is a developer of both surface and internal silver.

Since both surface and internal silver centers can have an adverse effect on emulsion photographic performance, testing for total fog is important. Separating the Au enhanced fog into its location i.e., surface or internal, is difficult, unreliable and, for these emulsions, unnecessary. The relative fogging propensity for a series of emulsions can be determined from Au-treated emulsions by comparing each average Au-enhanced fog level value. This value is obtained by taking the average of the four fog values obtained from development in KRX or KRX+KI, with and without prior surface bleach treatment. Comparisons of the average Au-enhanced fog level shows those emulsions having the fewest number and/or smallest size of silver centers introduced during precipitation, subsequent handling, and storage.

TABLE I

| | pH | | Storage | | | Fog Level (Minimum Density) | | | | |
|---|---|---|---|---|---|---|---|---|---|---|
| Example | Making | Storage | Time (Days) | Oxidizing Agent | Gold Treatment | KRX | Bleach, KRX | KRX-KI | Bleach, KRX-KI | Average |
| 1 | 2.0 | 5.6 | 6 | none | No | 0.038 | 0.069 | 0.057 | 0.051 | |
| (Invention) | | | | | Yes | 0.067 | 0.067 | 0.243 | 0.246 | 0.156 |
| 2 | 2.0 | 3.0 | 6 | none | No | 0.034 | 0.067 | 0.033 | 0.029 | |
| (Invention) | | | | | Yes | 0.046 | 0.066 | 0.055 | 0.057 | 0.056 |
| 3 | 2.0 | 2.0 | 6 | none | No | 0.036 | 0.070 | 0.030 | 0.032 | |
| (Invention) | | | | | Yes | 0.063 | 0.064 | 0.072 | 0.069 | 0.067 |
| " | " | " | 41 | " | No | 0.036 | 0.061 | 0.026 | 0.032 | |
| | | | | | Yes | 0.063 | 0.057 | 0.076 | 0.091 | 0.072 |
| 4 | 3.0 | 5.6 | 5 | none | No | 0.037 | 0.076 | 0.059 | 0.056 | |
| (Invention) | | | | | Yes | 0.084 | 0.072 | 0.256 | 0.288 | 0.175 |
| 5C | 4.0 | 5.6 | 8 | none | No | 0.038 | 0.066 | 0.162 | 0.162 | |
| (Control) | | | | | Yes | 0.400 | 0.124 | 0.422 | 0.497 | 0.361 |
| 6C | 5.0 | 5.6 | 12 | none | No | 0.032 | 0.056 | 0.066 | 0.054 | |
| (Control) | | | | | Yes | 0.396 | 0.117 | 0.344 | 0.325 | 0.296 |
| 7 | 2.0 | 5.6 | 1 | none | No | 0.037 | 0.056 | 0.038 | 0.029 | |
| (Invention) | | | | | Yes | 0.066 | 0.059 | 0.166 | 0.228 | 0.130 |
| " | " | " | 20 | " | No | 0.035 | 0.059 | 0.028 | 0.029 | |
| | | | | | Yes | 0.045 | 0.056 | 0.171 | 0.237 | 0.127 |
| " | " | " | 45 | " | No | 0.036 | 0.055 | 0.033 | 0.028 | |
| | | | | | Yes | 0.075 | 0.061 | 0.269 | 0.323 | 0.182 |
| " | " | " | 57 | " | No | 0.033 | 0.068 | 0.029 | 0.025 | |
| | | | | | Yes | 0.290 | 0.156 | 0.290 | 0.264 | 0.250 |
| " | " | " | 93 | " | No | 0.035 | 0.070 | 0.025 | 0.025 | |
| | | | | | Yes | 0.524 | 0.138 | 0.301 | 0.196 | 0.290 |
| 8C | 5.0 | 5.6 | 3 | Br | No | 0.028 | 0.072 | 0.033 | 0.027 | |
| (Control) | | | | | Yes | 0.077 | 0.065 | 0.152 | 0.173 | 0.117 |
| 9 | 2.0 | 2.0 | 4 | none | No | 0.031 | 0.056 | 0.066 | 0.048 | |
| (Invention) | | | | | Yes | 0.033 | 0.056 | 0.090 | 0.065 | 0.061 |

TABLE I-continued

| Example | pH Making | pH Storage | Storage Time (Days) | Oxidizing Agent | Gold Treatment | Fog Level (Minimum Density) KRX | Bleach, KRX | KRX-KI | Bleach, KRX-KI | Average |
|---|---|---|---|---|---|---|---|---|---|---|
| 10C | 5.0 | 5.6 | 1 | Br | No | 0.039 | 0.124 | 0.024 | 0.028 | |
| (Control) | | | | | Yes | 0.088 | 0.123 | 0.101 | 0.117 | 0.107 |
| 11C | 5.0 | 5.6 | 5 | none | No | 0.064 | 0.214 | 0.055 | 0.061 | |
| (Control) | | | | | Yes | 0.844 | 0.756 | 0.543 | 0.433 | 0.644 |
| 12 | 2.0 | 2.0 | 2 | none | No | 0.037 | 0.112 | 0.030 | 0.030 | |
| (Invention) | | | | | Yes | 0.065 | 0.110 | 0.059 | 0.057 | 0.073 |

The fog data presented in Table I shows the advantage of low pH precipitation and the further advantage of low pH storage of starch-made high-bromine emulsions. The effect of precipitation pH is demonstrated in a series of emulsions precipitated without added strong oxidant that differ only in the pH used for their precipitation. Comparing the average Au fog levels obtained for Examples 1, 4, 5C, and 6C, control emulsions Example 5C (precipitated at pH 4.0) and Example 6C precipitated at pH 5.0) gave very high average Au fog levels of 0.361 and 0.296 respectively. These average fog levels are approximately double those obtained for invention emulsions Example 1 (precipitated at pH 2.0, average Au fog levels of 0.156) and Example 4 (precipitated at pH 3.0, average Au fog levels of 0.175).

The storage pH of the emulsion before sensitization was found to be important for minimizing fog growth. The pH and time of storage, i.e., the number of days between making the emulsion and coating it (Au treatment was within 1 day of coating) are presented in Table I. Invention emulsion Example 7 was made at pH 2.0, in accordance with this invention, and stored at pH 5.6. It was Au treated and coated 1, 20, 45, 57, and 93 days after it had been precipitated. While there was little difference in the fog levels between the shorter storage times of 1 and 20 days, the average Au fog level significantly increased with longer storage time. In 45 days the average Au fog level increased by 40%. Invention emulsion Example 3, on the other hand, was stored at pH 2.0, and had only an 8% increase in average Au fog level after storage for 41 days.

Invention emulsions made and stored at low pH gave average Au fog levels improved over those made and stored at higher pH, even those made using strong oxidants. Invention emulsions Examples 2 and 3, made at pH 2.0 and stored (6 days) at pH 3.0 and 2.0 respectively, gave an average Au fog level of 0.056 and 0.067 respectively. Invention emulsion Example 9, doped with Ru, was made and stored (4 days) at pH 2.0, gave an average Au fog level of0.061. Control emulsion Example 6C, made at pH 5.0 without strong oxidant and stored (12 days) at pH 5.6, gave a poor average Au fog level of 0.296. Control emulsion Example 8C, made at pH 5.0 using bromine as a strong oxidant and stored (3 days) at pH 5.6, also gave an inferior average Au fog level of 0.117.

The last three Examples of Table I are a comparison of non-dislocation type tabular grain emulsions. The emulsions were precipitated without using an abrupt intrusion of iodide into the precipitation (e.g., a fine-grain-AgI or KI rapid addition step) and therefore would not contain edge and corner located grain dislocations. Control emulsion Example 10C, which employs bromine as an oxidant at pH 5.0, was made similarly to Emulsion S1 of U.S. Pat. No. 6,090,536, which has been shown to have good photographic performance with fragmentable electron donating sensitizers. It gave an average Au fog level of 0.107. Control emulsion Example 11 C, similarly prepared but without employing a strong oxidant, gave a very poor average Au fog level of 0.644. Invention emulsion Example 12, made and stored at pH 2, gave the best average Au fog level of 0.073 and did not use bromine or other strong oxidant.

The invention has been described in detail with particular reference to certain preferred embodiments thereof, but it will be understood that variations and modifications can be effected within the spirit and scope of the invention.

What is claimed is:

1. A process for precipitating a high bromide silver halide emulsion in an aqueous medium comprising growing nucleated silver halide grains in a reaction vessel by the reaction of soluble halide salt and a soluble silver salt in the presence of a peptizer comprising a water dispersable starch to form high bromide radiation-sensitive silver halide grains, wherein the majority of grain growth in the reaction vessel is performed at a pH of less than 3.5, and further comprising chemically sensitizing the precipitated silver halide grains, wherein the emulsion is stored at a pH of less than 3.5 between precipitation and chemical sensitization.

2. A process according to claim 1, wherein (a) the radiation-sensitive silver halide grains grown in the reaction vessel include tabular grains (1) having {111} major faces, (2) containing greater than 50 mole percent bromide, based on silver, and (3) accounting for greater than 50 percent total grain projected area, and (b) the peptizer is a water dispersible cationic starch.

3. A process according to claim 2 wherein the cationic starch is a water dispersible oxidized cationic starch.

4. A process according to claim 3 wherein the cationic starch contains α-D-glucopyranose repeating units and, on average, at least 1 percent of the α-D-glucopyranose repeating units are ring opened by oxidation.

5. A process according to claim 2, wherein the oxidation potential in the reaction vessel is less than 650 mV (Ag/AgCl ref.) during the majority of grain growth in the reaction vessel performed at a pH of less than 3.5.

6. A process according to claim 5, wherein greater than 90 mole % of the emulsion grains is precipitated in the reaction vessel at a pH of from 1.0 to 3.5 and an oxidation potential of less than 650 mV (Ag/AgCl ref.).

7. A process according to claim 5, wherein greater than 90 mole % of the emulsion grains is precipitated in the reaction vessel at a pH of from 1.0 to 3.0 and an oxidation potential of less than 650 mV (Ag/AgCl ref.).

8. A process according to claim 5, wherein greater than 90 mole % of the emulsion grains is precipitated in the reaction vessel at a pH of from 1.0 to 2.5 and an oxidation potential of less than 650 mV (Ag/AgCl ref.).

9. A process according to claim 2, wherein the storage is performed at a pH of from 1.0 to 3.0.

10. A process according to claim 2, wherein the storage is performed at a pH of from 1.0 to 2.5.

11. A process according to claim 2, wherein the storage is performed at a pH of from 1.0 to 2.0.

12. A process according to claim 1 wherein the starch is a water dispersible cationic starch.

13. A process according to claim 1 wherein the starch contains α-D-glucopyranose repeating units and, on average, at least 1 percent of the α-D-glucopyranose repeating units are ring opened by oxidation.

14. A process according to claim 1, wherein the oxidation potential in the reaction vessel is less than 650 mV (Ag/AgCl ref.) during the majority of grain growth in the reaction vessel performed at a pH of less than 3.5.

15. A process according to claim 14, wherein greater than 90 mole % of the emulsion grains is precipitated in the reaction vessel at a pH of from 1.0 to 3.5 and an oxidation potential of less than 650 mV (Ag/AgCl ref.).

16. A process according to claim 14, wherein greater than 90 mole % of the emulsion grains is precipitated in the reaction vessel at a pH of from 1.0 to 3.0 and an oxidation potential of less than 650 mV (Ag/AgCl ref.).

17. A process according to claim 14, wherein greater than 90 mole % of the emulsion grains is precipitated in the reaction vessel at a pH of from 1.0 to 2.5 and an oxidation potential of less than 650 mV (Ag/AgCl ref.).

18. A process according to claim 1, wherein greater than 70 mole % of the emulsion grains is precipitated in the reaction vessel at a pH of from 1.0 to 3.5.

19. A process according to claim 1, wherein greater than 70 mole % of the emulsion grains is precipitated in the reaction vessel at a pH of from 1.0 to 3.0.

20. A process according to claim 1, wherein greater than 70 mole % of the emulsion grains is precipitated in the reaction vessel at a pH of from 1.0 to 2.5.

21. A process according to claim 1, wherein the storage is performed at a pH of from 1.0 to 3.0.

22. A process according to claim 1, wherein the storage is performed at a pH of from 1.0 to 2.0.

23. A process according to claim 1, wherein the storage is performed at a pH of from 1.0 to 2.0.

24. A high bromide siIver halide photographic emulsion comprised of (a) high bromide radiation-sensitive silver halide grains, and (b) peptizer for the silver halide grains comprising a water dispersable starch, wherein the radiation sensitive silver halide grains have been precipitated in a reaction vessel by the reaction of soluble halide salt and a soluble silver salt in the presence of the starch peptizer, the majority of grain growth in the reaction vessel was performed at a pH of less than 3.5, and the emulsion is stored at a pH of less than 3.5.

* * * * *

UNITED STATES PATENT AND TRADEMARK OFFICE

CERTIFICATE OF CORRECTION

PATENT NO. : 6,395,465 B1
DATED : May 28, 2002
INVENTOR(S) : Maskasky et al.

It is certified that error appears in the above-identified patent and that said Letters Patent is hereby corrected as shown below:

Column 26,
Line 11, change "2.0" to -- 2.5 --

Signed and Sealed this

Twenty-third Day of November, 2004

JON W. DUDAS
*Director of the United States Patent and Trademark Office*